US005559592A

United States Patent [19]

Larson et al.

[11] Patent Number: 5,559,592

[45] Date of Patent: Sep. 24, 1996

[54] SINTERED IMAGE TRANSFER SYSTEM

[75] Inventors: James R. Larson, Fairport; David H. Pan, Rochester; John S. Berkes, Webster, all of N.Y.

[73] Assignee: Xerox Corporation, Stamford, Conn.

[21] Appl. No.: 497,561

[22] Filed: Jun. 30, 1995

[51] Int. Cl.[6] ..... G03G 15/20

[52] U.S. Cl. ..... 355/285; 355/256; 430/124

[58] Field of Search ..... 355/285–291, 355/282, 271, 256; 430/97–99, 126, 124

[56] References Cited

U.S. PATENT DOCUMENTS

| | | | |
|---|---|---|---|
| 3,923,392 | 12/1975 | Buchan et al. | 355/3 R |
| 4,708,460 | 11/1987 | Langdon | 355/10 |
| 4,796,048 | 1/1989 | Bean | 355/3 TR |
| 5,110,702 | 5/1992 | Ng et al. | 430/99 |
| 5,233,397 | 8/1993 | Till | 355/279 |
| 5,253,021 | 10/1993 | Aslam et al. | 355/290 X |
| 5,276,492 | 1/1994 | Landa et al. | 355/277 |
| 5,353,105 | 10/1994 | Gundlach et al. | 355/279 |

*Primary Examiner*—R. L. Moses
*Attorney, Agent, or Firm*—Denis A. Robitaille

[57] ABSTRACT

A method and apparatus for transferring a developed image made up of toner particles and a liquid carrier to copy sheet, wherein the developed image is heated to a temperature such that the toner particles are sintered to form a coherent bonded network of toner particles without melting the individual toner particles to form a substantially solid mass, and where the coalesced toner particles still retain mobility in an electrostatic field.

21 Claims, 2 Drawing Sheets

SINTERED IMAGE TRANSFER SYSTEM

Figure 1:
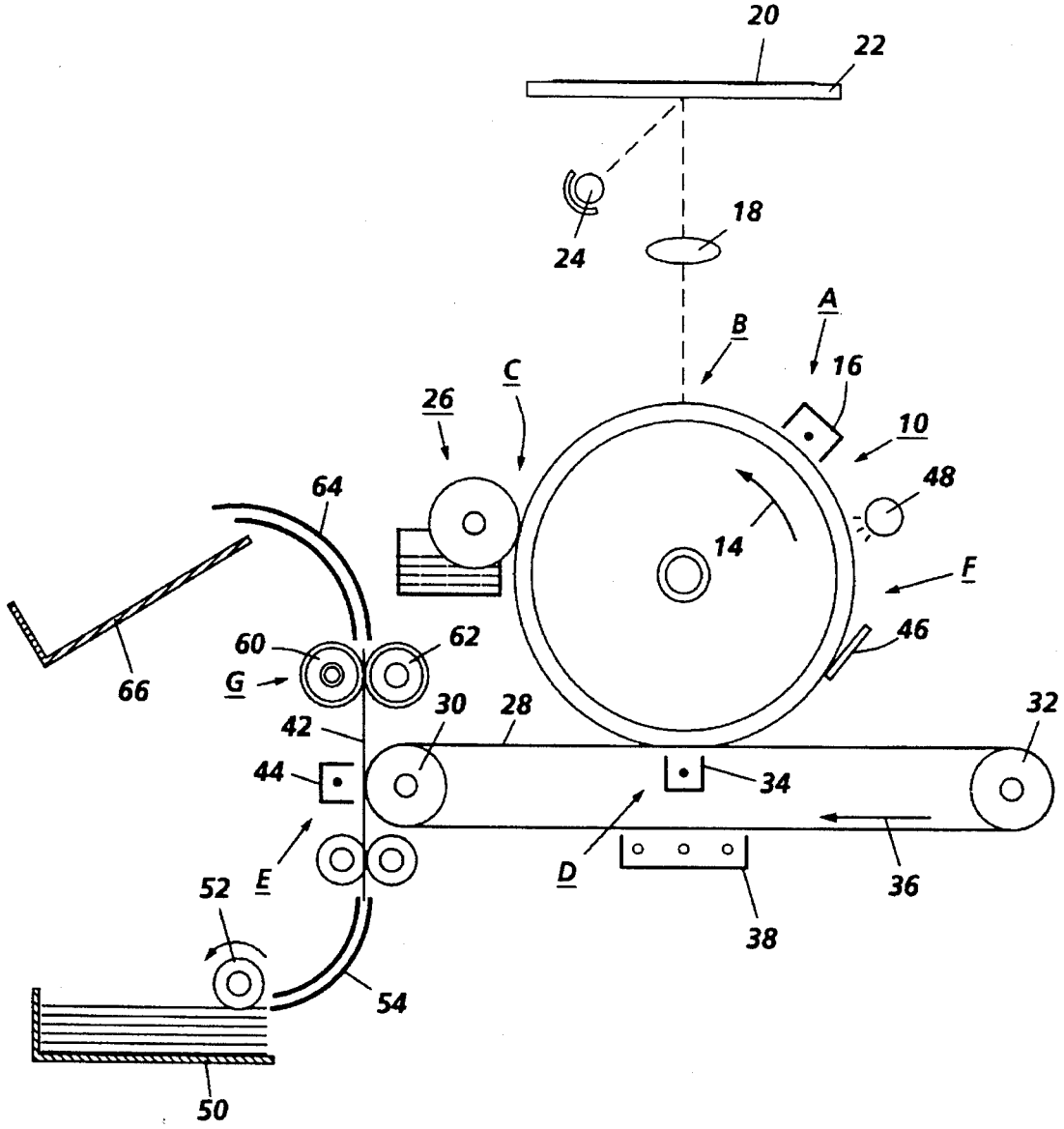

This invention relates generally to an electrostatographic printing machine, and more particularly concerns a system for transferring a sintered image to a copy substrate.

Generally, the process of electrostatographic copying or printing is initiated by exposing a light image of an original document to a substantially uniformly charged photoreceptive member. Exposing the charged photoreceptive member to a light image discharges a photoconductive surface thereon in areas corresponding to non-image areas in the original input document while maintaining the charge in image areas, resulting in the creation of an electrostatic latent image of the original document on the photoreceptive member. This latent image is subsequently developed into a visible image by a process in which developer material is deposited onto the photoreceptive member. Typically, this developer material is a dry powder comprised of carrier granules having toner particles adhering triboelectrically thereto, wherein the toner particles are electrostatically attracted to the latent image from the carrier granules to form a powder toner image on the photoreceptive member. Alternatively, liquid developers comprising a liquid carrier material having toner particles dispersed therein have been utilized, wherein the liquid developer is applied to the latent image to form a liquid image with the toner particles in the liquid image being attracted toward the latent image areas. Regardless of the type of developer material employed, after the latent image is developed, the toner particles are then transferred from the photoreceptive member to a copy sheet, either directly or indirectly via an intermediate transfer member. Once on the copy sheet, the image may be permanently affixed to provide a "hard copy" reproduction of the original document. In a final step, the photoreceptive member is cleaned to remove any residual developing material from the photoconductive surface in preparation for subsequent imaging cycles.

Transfer of a powder or a liquid image to the copy sheet or to an intermediate transfer member is generally achieved by applying an electrostatic force in a transfer zone to overcome the forces holding the developed image to the photoconductive surface. Historically, transfer of toner images between support surfaces in electrostatographic applications is accomplished via electrostatic induction using a corotron or other corona generating device for spraying ions onto the backside of a copy substrate to attract toner particles thereto. Another well known technique involves the use of an electrically biased roll member or belt adapted to engage with the backside of the copy substrate to induce image transfer. Alternative techniques which involve heating the developed image on the image bearing surface and using pressure to induce transfer over to the copy sheet are also known and have been disclosed.

The critical aspect of the transfer process focuses on the physical detachment and transfer-over of charged particulate toner materials from one surface to a second supporting surface without scattering or smearing of the developer material. When using electrostatic forces to induce the transfer process, careful control of the electrostatic fields across the transfer region is required so that the fields are high enough to effect toner transfer while being low enough so as not to cause arcing or excessive corona generation or ionization at undesired locations. Imprecise and inadvertent electrostatic fields can create copy or print defects by inhibiting toner transfer or by inducing uncontrollable toner transfer, causing scattering or smearing of the development materials. Various types of transfer systems have hereinbefore been used as illustrated by the following disclosures, which may be relevant to certain aspects of the present invention:

U.S. Pat. No. 3,923,392

Patentee: Buchan et al.

Issued: Dec. 2, 1975

U.S. Pat. No. 4,708,460

Patentee: Langdon

Issued: Nov. 24, 1987

U.S. Pat. No. 4,796,048

Patentee: Bean

Issued: Jan. 3, 1989

U.S. Pat. No. 5,233,397

Patentee: Till

Issued: Aug. 3,1993

U.S. Pat. No. 5,276,492

Patentee: Landa et al.

Issued: Jan. 4, 1994

U.S. Pat. No. 5,353,105

Patentee: Gundlach et al.

Issued: Oct. 4, 1994

The relevant portions of the foregoing patents may be briefly summarized as follows:

U.S. Pat. No. 3,923,392 discloses an electrophotographic copier having a transfer and fusing system including an elastomeric transfer belt, preferably having a low heat capacity and being formed from a silicone elastomer, operating in combination with a radiant fuser and a paper transport system which provides increased thermal efficiency.

U.S. Pat. No. 4,708,460 discloses a copy apparatus in which a liquid image is transferred from a photoconductive member to an intermediate member positioned closely adjacent thereto, wherein the liquid image is subsequently simultaneously transferred and fused onto a copy sheet to form a copy of the original document.

U.S. Pat. No. 4,796,048 discloses an apparatus in which a plurality of liquid images are transferred from a photoconductive member to a copy sheet, wherein the liquid images, which include a liquid carrier having toner particles dispersed therein, are attracted from the photoconductive member to an intermediate belt by a biased transfer roll which simultaneously squeegees the liquid carrier from the intermediate belt while compacting the toner particles in image configuration. Thereafter, the toner particles are transferred from the intermediate belt to the copy sheet in image configuration with the use of another biased transfer roll. A vacuum source and an infrared heater are employed to remove residual solvent from the intermediate member left after photoconductor to intermediate member transfer takes place.

U.S. Pat. No. 5,233,397 discloses an apparatus for transferring a developed image from a surface to a heated intermediate member. The intermediate member is reheated to at least partially melt the image therein. Thereafter, the image is transferred from the intermediate member to a sheet and fixed thereto.

U.S. Pat. No. 5,276,492 discloses a method and apparatus for transferring liquid toner images from an image forming surface to an intermediate transfer member for subsequent transfer to a final substrate. The liquid toner images include carrier liquid and pigmented polymeric toner particles which are essentially non-soluble in the carrier liquid at room temperature, and which form a single phase at elevated temperatures. The method of that patent includes the steps of: concentrating the liquid toner image by compacting the solids portion of the liquid toner image and removing carrier liquid therefrom; transferring the liquid toner image to the intermediate transfer member; heating the liquid toner image on the intermediate transfer member to a temperature at which the toner particles and the carrier liquid form a single phase; and transferring the heated liquid toner image to a final substrate.

U.S. Pat. No. 5,353,105 discloses a method and apparatus for printing using an intermediate member acting as a receptor for marking particles representing an image. The marking particles may be deposited directly or indirectly on the member, after which time the member is exposed, via an internal heat source, to an elevated temperature sufficient to cause the melting and coalescing of the marking particles. Subsequently, the intermediate member is advanced so as to place the tackified marking particles present on the outer surface thereof into intimate contact with the surface of a recording sheet.

In accordance with one aspect of the present invention, there is provided an apparatus for transferring a developed image including a plurality of individual toner particles to an image support surface comprising means for heating the developed image to a given temperature such that the developed image is sintered to form a coherent bonded network of toner particles without melting the individual toner particles or forming a substantially solid mass thereof and means for transferring the sintered image to the image support surface.

Pursuant to another aspect of the present invention, there is provided an electrostatographic printing machine including an apparatus for transferring a developed image including a plurality of individual toner particles to an image support surface comprising means for heating the developed image to a given temperature such that the developed image is sintered to form a coherent bonded network of toner particles without melting the individual toner particles into a substantially solid mass and means for transferring the sintered image to the image support surface.

Pursuant to yet another aspect of the present invention, there is provided a method for transferring a developed image including a plurality of individual toner particles situated in image configuration on an image bearing surface, to an image support surface, comprising the steps of heating the developed image on the image bearing surface so as to sinter the image thereon without melting the individual toner particles into a substantially solid mass and transferring the sintered image from the image bearing surface to an image support surface.

Pursuant to yet one more aspect of the present invention, there is provided an electrostatic imaging process comprising the steps of developing an electrostatic latent image on a moving image bearing surface with developing material including toner particles and a liquid carrier to form a developed liquid image on the image bearing surface, and heating the developed liquid image to a selected temperature such that the developed liquid image is sintered to form a coherent bonded network of toner particles without melting the individual toner particles into a substantially solid mass, the selected temperature being determined as a function of properties of the toner particles, properties of the liquid carrier, and a rate of transport of the developed liquid image on the image bearing surface.

Figure 2:
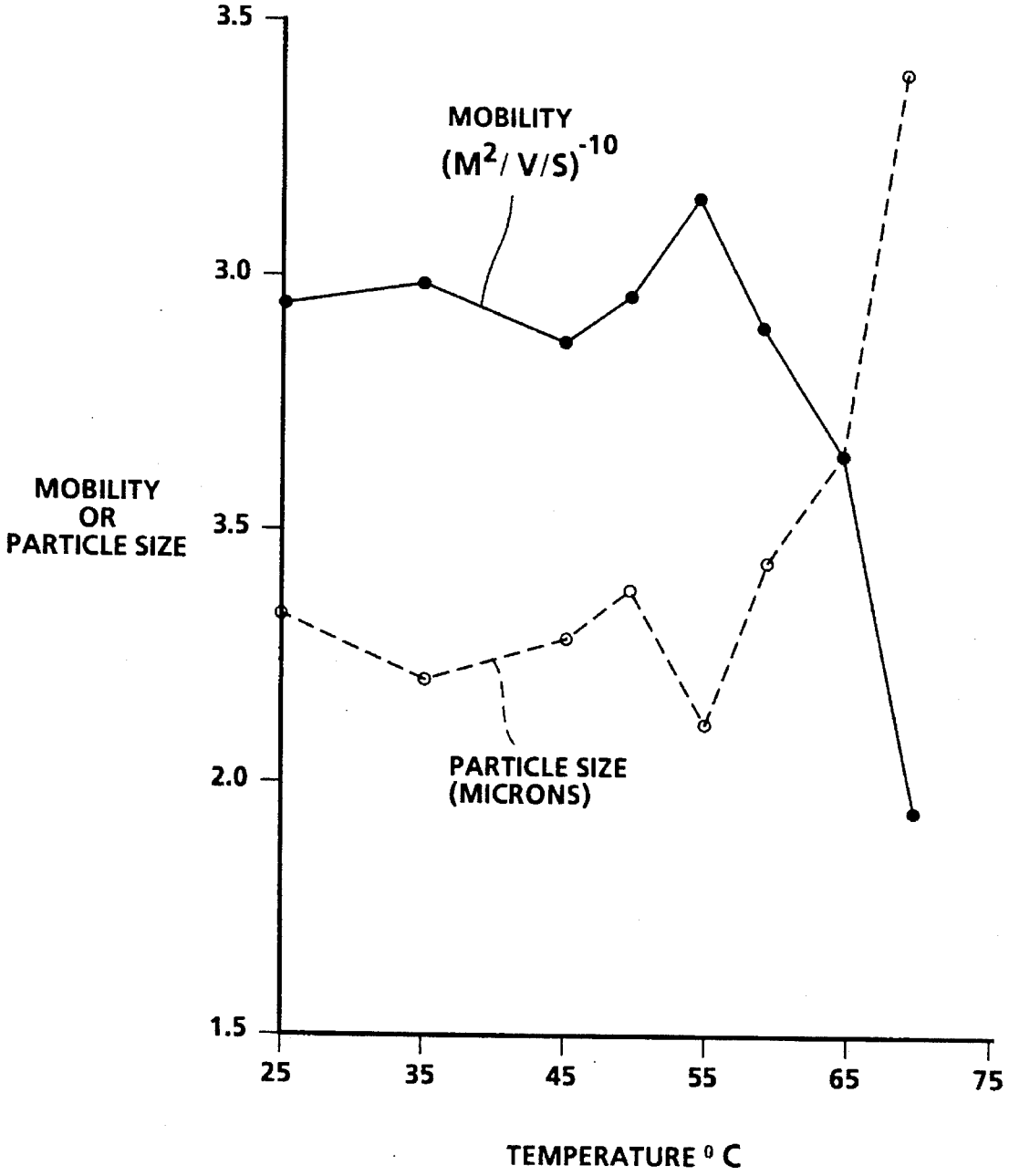

Other aspects and features of the present invention will become apparent as the following description proceeds and upon reference to the drawings, wherein like reference numerals have been used throughout to designate identical or similar elements:

FIG. 1 is a schematic elevational view of an electrostatographic printing machine incorporating a sintered image transfer system in accordance with the present invention; and FIG. 2 is a graphical representation showing the effect of temperature on specific toner particle properties such as particle size and mobility.

While the present invention will be described in connection with a preferred embodiment thereof, it will be understood that the description is not intended to limit the invention to the embodiment shown and described herein. On the contrary, the present description is intended to cover all alternatives, modifications and equivalents as may be included within the spirit and scope of the invention as defined by the appended claims.

Inasmuch as the art of electrophotographic printing is well known, the various processing stations employed in the printing machine will be shown hereinafter schematically and their operation described briefly with reference thereto.

Referring initially to the FIG. 1, the exemplary electrostatographic printing machine shown thereat employs a photoreceptive drum member 10 having a photoconductive surface deposited on an electrically grounded conductive substrate. One skilled in the art will appreciate that any suitable photoconductive material may be utilized. Drum 10 moves in the direction of arrow 14 to advance successive portions of photoconductive surface sequentially through the various processing stations disposed about the path of movement thereof. Timing detectors (not shown) are provided for monitoring the rotation of the drum and for communicating with a machine controller (not shown) to synchronize the operations of the various processing stations to effect the proper sequence of events, as will be described.

Initially, a portion of drum 10 passes through a charging station, identified by reference letter A where a corona generating device 16 is driven by a high voltage power supply (not shown). The corona generating device produces a flow of ions directed toward the drum 10 to charge the photoconductive surface thereof to a relatively high, substantially uniform potential.

After the photoconductive surface of drum 10 is charged, the charged portion thereof is advanced in the direction of arrow 14 through exposure station B where an original document 20 is exposed to generate an image on the photoconductive surface. During the exposure process, the original document 20 is placed face down on a transparent platen 22 which is thereafter flooded with light via lamp 24. Light rays reflected from the original document 20 are transmitted through a lens 18, forming a light image of the original document 20 onto the charged portion of the photoconductive surface of drum 10 for selectively dissipating the charge thereon to generate an electrostatic latent image corresponding to the informational areas contained within original document 20. Alternatively, a raster output scanner including a modulated laser in combination with a rotating polygon mirror or some other image processing device may be used in lieu of the light lens system described hereinabove to produce an image comprising a series of picture elements or so-called pixels.

After the electrostatic latent image has been recorded on the photoconductive surface, drum 10 continues to be advanced in the direction of arrow 14 to a development station C where a developer system deposits charged toner particles on the latent image to produce a developed image on the surface of drum 10. As previously indicated, the developed image can be generated via a developer material of the type which is a dry powder or a liquid developer material. Typical powder type developers comprise carrier granules having toner particles adhering triboelectrically thereto, wherein the toner particles are electrostatically attracted to the latent image from the carrier granules to form a powder toner image on the photoreceptive member. Alternatively, liquid developers comprise an insulating liquid carrier material having toner particles made from a pigmented resin dispersed therein. A suitable liquid carrier material may be made from aliphatic hydrocarbon having a low boiling point, such as, for example, Isopar, a trademark of the Exxon Corporation, while a typical toner material might include a pigment such as carbon black associated with a polymer resin such as Nucrel 599 available from E.I. DuPont de Numours & Co. of Willimington, Del. A suitable liquid developer material is described in U.S. Pat. No. 4,582,774, the relevant portions thereof being hereby incorporated by reference into the present application. Regardless of the type of developer material utilized, the developer material is generally applied to the the latent image with the toner particles being attracted toward the latent image areas. An appropriately electrically biased development electrode (not shown), may also be provided to assist in developing the electrostatic latent image with the toner particles such that the charged toner particles are transported to the electrostatic latent image by electrostatic forces or by electrophoresis. It will be understood by those of skill in the art that development may be accomplished by developing the charged ares of the photoreceptor, so-called charged area development (CAD) or by developing discharged areas, so-called discharged area development (DAD).

After the toner particles have been deposited onto the electrostatic latent image for development thereof, the drum 10 is advanced to a transfer station D, where the developed image is transferred onto an intermediate transfer member, such as a belt 28, although it will be understood that the intermediate member could also be a drum type member. Transfer of the developed image to belt 28 is induced by a corona generating device 34 which may be of the same form as that described with respect to charging station A, wherein the corona generating device 34 generates a charge for electrostatically transferring the image from the photoreceptive drum 10 to the intermediate transfer member. It will be understood that various other devices can be utilized to provide the same image transfer function, as for example, an electrically biased roll member positioned adjacent the backside of the belt 28 for attracting the developed image thereto. The belt 28 is made from a suitable flexible material such as Silicone rubber or Viton® which is supported in contact with drum 10. The belt 2B is entrained about rollers 30 and 32 which are rotatably driven by a suitable motor in association with a drive system (not shown) for transporting the belt 28 in the direction of arrow 36 at a tangential velocity identical to the rotational velocity of drum 10 so that successive images may be transferred to the same region of the belt, thereby enabling the transfer of plural images in superimposed registration for producing multilayer color images, as is well known in the art of electrostatographic printing.

In accordance with the present invention, the intermediate transfer member operates in combination with a heating element 38 which might take the form of a radiant heater disposed externally from the belt 28, as shown schematically in FIG. 1. Alternatively, various other forms of heating elements may be provided, as for example, an infrared lamp positioned in the interior of rollers 30 and/or 32 or an electrical or chemically activated heating element embedded within the layers of belt 28, among other known devices. The heating element 38 is provided as a means for heating the image on the intermediate transfer belt 28, and more specifically, for sintering the image by heating the toner particles to form a coherent bonded network without melting the individual toner particles into a substantially solid mass. Thus, it is an important feature of the present invention that thermal energy is provided to the image such that the toner particles making up the image are heated to a temperature below their melting point, causing the toner particles to coalesce into an interlocking system of individual particles without actually becoming liquefied. Heating the toner particles to a point just below the melting point or just below the solvation temperature results in the formation of allotropic crystals which allows the individual toner particles to fuse or weld together and agglomerate while the individual toner particles substantially retain their particular identity and their respective particle charge. The sintered image takes the form of a particle network wherein the toner particles are interconnected by an adhesive force without the assistance of a binder material where some particle coalescence can be observed while retaining particle mobility in an electrostatic field.

The sintered image on intermediate belt 28 is subsequently transported to transfer station E where the image is brought into contact with a sheet of support material such as a copy sheet 42. In operation, a sheet feeding apparatus, preferably including a feed roll 52 contacting the uppermost sheet of stack 50, advances the copy sheet 42 from stack 50 into a chute 54 which directs the advancing copy sheet 42 into contact with the belt 28 in a timed sequence so that the sintered image thereon contacts the advancing sheet at a position aligned with the transfer station, generally designated by reference letter E. Although a cut sheet feeding apparatus is described, it will be understood that a web feed system may also be advantageously utilized with the present invention.

Since sintering of the developed image on belt 28 has the effect of creating a network of interconnected toner particles, wherein the individual toner particles have retained their respective particle charge, the image can be transferred to the copy sheet 42 via known electrostatic methods. Thus, as shown in FIG. 1, the transfer station E includes a charging device, as for example, another corona generating device 44, for electrostatically attracting the toner particles in image configuration from belt 28 to the copy sheet 42. However, transferring a sintered image differs from previously known electrostatic image transfer processes since the image is transferred as a coalesced single mass, resulting in stable image transfer with enhanced transfer efficiency.

After the image has been transferred to the copy sheet 42, the copy sheet is advanced to a fixing or fusing station, indicated generally by the reference letter G. An exemplary fusing station including a heated fuser roll 60 and a backup pressure roll 62 forming a fuser nip therebetween is shown in FIG. 1, wherein the copy sheet 42 passes through the fuser nip so that the toner image on the copy sheet 42 is heated for being affixed thereto. Thereafter, the recording substrate 42 is advanced through a chute 64 for transporting the final output document to a catch tray 66 to be removed by a machine operator.

One additional subsystem is also provided for removing residual developer material which may remain adhering to the photoconductive surface of drum 10. Cleaning station F includes a cleaning blade 46 in contact with photoconductive surface of drum 10, whereby the residual toner particles are cleaned from photoconductive surface by the rotation of drum 10 in contact therewith. Subsequent to cleaning, a discharge lamp 48 floods the photoconductive surface with light to dissipate any residual electrostatic charge remaining thereon prior to the charging thereof for the next successive imaging cycle.

The foregoing describes the features of the present invention generally in terms of the notion of heating the developed image in order to facilitate transfer to a copy substrate. As described, it is preferable to provide such heating so as to sinter the image, defined as heating the toner particles without melting them to form a coherent bonded mass of toner particles to transfer. FIG. 2 provides a graphical representation of the effect of heat on an exemplary liquid developer material including a mixture of Nucrel 599 polymer resin (available from E.I. DuPont de Numours & Co.) with cyan pigment acting as a toner (available from E.I. DuPont de Numours & Co.) emerged in a liquid carrier, namely Isopar M (available from Exxon Corp.). As can be seen from FIG. 2, at least two properties of the toner particles are effected by heating, namely the mobility of the toner particles (measured in meter 2/volt/second) and the particle size in microns. Thus, it can be seen from the graph of FIG. 2 that particle mobility remains relatively constant until a critical temperature at which the mobility of the particles decrease rapidly. Likewise, particle size remains relatively constant until a critical temperature at which the size increases rapidly. It is noted that these properties vary with heat, independent of the concentration of the toner particles in the liquid carrier. The thermal properties of the toner particles are factors which determine the amount of particle coalescence resulting from heating and sintering of the toner particles.

EXAMPLE I

Preparation of Toner

One hundred and seventy nine point five (179.5) grams of NUCREL 599®, a copolymer of ethylene and methacrylic acid with a melt index at 190° C. of 500 dg/minute, available fro E.I. Dupont de Nemours & Company, Wilmington, Del., 45.4 grams of the cyan pigment PV Fast BlueTM, 2.3 grams of ALOHAS and 307.4 grams of NORPAR 15®, carbon chain of 15 average, available from Exxon Corporation, were added to a Union Process 1S attritor (Union Process Company, Akron Ohio) charged with 0.1875 inch (4.76 millimeters) diameter carbon steel balls. The mixture was milled in the attritor which was heated by running steam through the attritor jacket at 85° to 92° C. for 2 hours and cooled by running water through the attritor jacket to 26° C. An additional 980.1 grams of NORPAR 15® were added, and ground in the attritor for and additional 4.5 hours. An additional 1,550.7 grams of NORPAR 15® were added and the mixture was separated from the steel balls by the use of a metal grate yielding a liquid toner concentrate of of 7.21 percent solids, wherein solids include resin, charge adjuvant, and pigment, and 92.79 percent NORPAR 15®. The particle diameter was 2.3 microns average by area as measured with a Horiba CAPA 700. The toner was charged with 3945 Mn 80:20 HBr quat charge director at a level of 30 mg of charge director per gram of toner solids. Sufficient NORPAR 15® was added to these samples to result in a final concentration of 2 weight percent. The dynamic mobility was measured on each of the samples with a Matec ESA measurement device.

Heat Treatment of Toner

Approximately 500 grams of the toner described hereinbefore was placed into a double walled glass vessel which was heated by passing heated water through the jacket. A thermometer was used to monitor the temperature of the contents. The toner was heated to 25° C. for 6 hours and then cooled to 20° C. overnight and electrical measurements were taken on the material in the double walled flask. An aliquot was taken the following day for particle size analysis. The remaining materials were then heated to 35° C. for 6 hours as in the previous method and were allowed to cool overnight with a sample taken and electrical measurements made. This procedure was followed for 45 C., 50 C. (in this case the heating was conducted for 4 days), 55 C., 60 C., 65 C. and 70 C. The median area particle size of the aliquots of heated toner was measured on the Horiba CAPA 700 particle size analyzer. It will be understood from this example that the temperature required for providing the proper amount of thermal imaging to achieve the desired sintering is determined as a function of the properties of the pigmented polymer or toner particles utilized, the properties of the liquid carrier and the actual dwell time for exposure of the mixture to the elevated temperatures. It will be further understood that the dwell time in an operational electrostatographic machine is a function of the rate of transport of the developed liquid image on the image bearing surface.

In review, a developed image is heated to a temperature just below the lowest melting point of the toner particles making up the image for producing a sintered image where some particles coalescence can be observed while retaining particle mobility in an electrostatic field prior to transfer to a sheet of support material. It is, therefore, apparent that there has been provided in accordance with the present invention, a transfer system that fully satisfies the aims and advantages hereinbefore set forth. While this invention has been described in conjunction with a specific embodiment thereof, it is evident that many alternatives, modifications, and variations will be apparent to those skilled in the art. For example, although the present invention has been described in terms of heating the toner particles on an intermediate transfer belt, it will be understood that a developed image could be heated directly on the photoreceptive member to create a sintered image thereon which is thereafter transferred, either directly or indirectly, to a copy substrate. Accordingly, the present invention is intended to embrace all such alternatives, modifications and variations that fall within the spirit and broad scope of the appended claims.

We claim:

1. An apparatus for transferring a developed image including a plurality of individual toner particles from a photoreceptive imaging member to an image support surface, comprising:

means for heating the developed image on the photoreceptive imaging member to a given temperature such that the developed image is sintered to form a coherent bonded network of toner particles on the photoreceptive imaging member without melting the individual toner particles into a substantially solid mass; and means for transferring the sintered image to the image support surface.

2. The apparatus of claim 1, wherein the image support surface includes a copy sheet.

3. The apparatus of claim 1, wherein the image support surface includes an intermediate transfer member.

4. The apparatus of claim 1, wherein said transferring means includes a corona generating device.

5. The apparatus of claim 1, wherein said transferring means includes an electrically biased roll member.

6. The apparatus of claim 1, wherein the developed image includes a liquid carrier material.

7. An electrostatographic printing machine including an apparatus for transferring a developed image including a plurality of individual toner particles from a photoreceptive imaging member to an image support surface, comprising:

means for heating the developed image on the photoreceptive imaging member to a given temperature such that the developed image is sintered to form a coherent bonded network of toner particles on the photoreceptive imaging member without melting the individual toner particles into a substantially solid mass; and means for transferring the sintered image to the image support surface.

8. The electrostatographic printing machine of claim 7, wherein the image support surface includes a copy sheet.

9. The electrostatographic printing machine of claim 7, wherein the image support surface includes an intermediate transfer member.

10. The electrostatographic printing machine of claim 7, wherein said transferring means includes a corona generating device.

11. The electrostatographic printing machine of claim 7, wherein said transferring means includes an electrically biased roll member.

12. The electrostatographic printing machine of claim 7, wherein the developed image includes a liquid carrier material.

13. A method for transferring a developed image including a plurality of individual toner particles situated in image configuration on an image bearing surface including a photoreceptive imaging member to an image support surface, comprising the steps of:

heating the developed image on the photoreceptive imaging member so as to sinter the image thereon without melting the individual toner particles; and transferring the sintered image from the image bearing surface to an image support surface.

14. The method of claim 13, wherein the image support surface includes a copy sheet.

15. The method of claim 13, wherein the image support surface includes an intermediate transfer member.

16. The method of claim 13, wherein the image bearing surface includes a photoreceptive member.

17. The method of claim 13, wherein said transferring step includes the application of electrostatic forces for attracting the sintered image from the image bearing surface.

18. The method of claim 13, wherein said transferring step includes the simultaneous application of electrostatic forces and mechanical pressure for attracting the developed image from the image bearing surface.

19. The method of claim 13, wherein the developed image includes a liquid carrier material.

20. An electrostatic imaging process comprising the steps of developing an electrostatic latent image on a moving image bearing surface with developing material including toner particles and a liquid carrier to form a developed liquid image on the image bearing surface; and heating the developed liquid image to a selected temperature such that the developed liquid image is sintered to form a coherent bonded network of toner particles without melting the individual toner particles into a substantially solid mass, wherein the selected temperature is determined as a function of properties of the toner particles, properties of the liquid carrier, and a rate of transport of the developed liquid image on the image bearing surface.

21. The process of claim 20 further including a step of applying electrostatic fields to the developed image for transferring developed image from the image bearing surface to a support surface, wherein the selected temperature of said heating step is determined by providing sufficient thermal energy to the developed image to cause substantial coalescence of the toner particles on the image while retaining mobility of the toner particles in presence of the electrostatic fields.

* * * * *